US006478300B1

(12) United States Patent
Pickett

(10) Patent No.: US 6,478,300 B1
(45) Date of Patent: Nov. 12, 2002

(54) CHECKER-TYPE GAME FOR FOUR PLAYERS

(76) Inventor: James Henry Pickett, 5302 Broadwater Ct., Temple Hills, MD (US) 20748

( * ) Notice: Subject to any disclaimer, the term of this patent is extended or adjusted under 35 U.S.C. 154(b) by 0 days.

(21) Appl. No.: 09/875,933

(22) Filed: Jun. 8, 2001

(51) Int. Cl.[7] ..... A63F 3/00
(52) U.S. Cl. ..... 273/260; 273/258; 273/290
(58) Field of Search ..... 273/260, 261, 273/262, 255, 290, 288, 242, 258

(56) References Cited

U.S. PATENT DOCUMENTS 1,472,657 A * 10/1923 Lillard ..... 273/260
2,196,861 A * 4/1940 Gruber ..... 273/282.1
2,665,913 A * 1/1954 Hlavac ..... 235/90
3,751,039 A * 8/1973 Dykoski ..... 273/241
4,326,720 A * 4/1982 Erlich
4,984,808 A * 1/1991 Young ..... 206/315.1
5,314,189 A * 5/1994 Kerivan ..... 273/260
6,142,474 A * 11/2000 Tachkov et al. ..... 273/260

OTHER PUBLICATIONS

Fred Reinfeld, Book Excerp, How To Win At Checkers, pp. 178–184 (1957).

* cited by examiner

*Primary Examiner*—Benjamin H. Layno
*Assistant Examiner*—Vishu K Mendiratta
(74) *Attorney, Agent, or Firm*—M.H. Sears Law Firm CHTD; Mary Helen Sears

(57) ABSTRACT

A checkers game for four players is disclosed, in which each player commencing with six checkers in an assigned quadrant of a conventional checkers board. The checkers are converted to super-monarchs having superior powers with a double riser piece or to monarchs having lesser but increased power with a single riser piece upon reaching certain specified position in any opposing player territory.

3 Claims, 5 Drawing Sheets

CHECKER-TYPE GAME FOR FOUR PLAYERS

BACKGROUND OF THE INVENTION

The classic game of "checkers" has been varied in numerous ways over the years. It is usually a two-person game in which one-half of the classic checkerboard comprising 32 squares—16 of one color (usually black) and 16 of another color (usually red)—is the domain of one player and the other one-half is the domain of a second player.

In the sphere of board games that have become popular, one innovation involves "sports checkers "—i.e. combining checkers with the theme of an active sport, such as football, basketball, tennis, golf, hockey, soccer, baseball or bowling. These games may use helmets or balls or conventional pieces in colors characteristic of well known professional or college teams as the "checker" pieces in lieu of the round chips of monocolor wood, plastic or another solid material most commonly called checker pieces. For these games, ways of scoring for the capture of one of the opponent's checker pieces or for attaining "king" status by successfully moving a piece to the front row of the opponent's territory have been devised that are analogized to the scoring used in the particular sport. In golf checkers and tennis checkers, each of the players contends as himself; in the other sports, the players each contend as a well-known professional, semiprofessional or college sports team.

There are also known variations of checkers and other board games wherein they have been implemented on personal computers, on a host network; or in an integral small device where a single player typically plays against the device. It is contemplated that the herein disclosed version of checkers may also be so implemented using appropriate software or a suitable microchip.

The present variation of the classic checkers board game makes changes in the game and how it is played, but includes the possibility of using conventional checker pieces, sports emblems, sports figure pieces and other decorative pieces as "checkers" as hereinafter described.

BRIEF DESCRIPTION OF THE INVENTION

A basic feature of the present game and the equipment for playing it is the provision of a checker board of regulation number of squares which, however, is accommodated to fourperson play by being divided into quadrants. On this 4-part board, normally one-half of the 64 squares are of a single color, which can be black, white or any other color desired. This color is, for purposes of this application, denoted the "background color". The other 32 squares, however, which alternate in typical checkerboard fashion with squares of the background color, are of a different color from the background color. The different color may vary in each of the four quadrants of the board or it may be uniform. When the different color is a uniform color, each quadrant may be distinguished from the other three quadrants in any of a variety of ways. Thus, one or more of the squares of a given quadrant may be marked with a colored dot or other colored emblem, the color or shape or other identifying characteristic of which corresponds to that of one six-piece set of checker pieces. This marker may be an applied decal, a painted-on symbol or any other marking that will assist the players in distinguishing the quadrants from one another without obstructing the normal play of the game in any way. When only one square of each quadrant is marked, it is preferably one of the outermost squares at or near to the corner of the board. When more than one but less than all squares of the quadrant are marked, it is preferable that the marked squares be the superking/superqueen-making squares and king/queen-making squares of the quadrant. The overall board may be of the same size as a conventional board, or it may be somewhat enlarged with larger sized squares than the conventional board so as to make it more comfortable for 4-person play. If enlarged, its ultimate shape is still that of a perfect square.

The "checker" pieces of each of the four game players are likewise distinguished from one another in some manner. For example, four different colors of conventional round wood, plastic, or like material ordinary checkers may be supplied. Alternatively, four sets of more fanciful "checker" pieces as suggested hereinafter, may be used, with each 6-piece set so constructed as to be readily distinguishable from the other such sets. The game as supplied will accordingly contain of 4 sets of 6 checker pieces, distinguished from one another in some way as more particularly described hereinafter.

The game as supplied will also include a number of appropriately shaped and constructed "underchecker" or "riser" pieces, each adapted to fit beneath a checker piece to form a king or a queen when a checker has successfully been moved to an appropriate position on the board as hereinafter described. The risers may also be so formed that two of them can fit together and then be stacked under a checker piece to form a "superking" or "superqueen" when a checker has successfully been moved to an appropriate position of the board, as described below. If desired, double height and single height risers can be supplied and the need to stack two risers together can be eliminated.

When four players play the game, each one plays against all three of the other players. Three players can play if one of them undertakes to play two 6-member sets of checkers against each other and also against the sets of the other two players, and if only two players play, each one plays two 6-member checker sets against each other and also against the two sets of the other player.

The play of this game differs from classical checkers in that even the ordinary checkers in this game can be moved in either forward or reverse direction, one square at a time. Another difference is that when an ordinary checker reaches a square in the 8-square outermost row of any opponent's quadrant (which row includes two cornerpieces of the board), either at the opposite side of the board or a square in the 4-square section including one cornerpiece in the opponent's territory on the side adjacent his own location, that checker becomes a superking or superqueen. When an ordinary checker enters a square in an opponent's quadrant that is within the 6-squares on an edge of the board between the two 8-square outside superking/superqueen-making rows, it becomes a king or queen. A king or queen has the same powers as kings and queens do in conventional checkers and also has the power to jump and thereby capture a superking or superqueen that is positioned in a square adjacent to the position of the king or queen with an empty square behind it. The superking and superqueen can capture all of any opponent's checkers (including kings and queens) that are in its direct path or in any direct path that opens to it after it has already moved several spaces by path-clearing. For example, a superking or superqueen may jump over and clear from the board 3 or 4 opposing checkers in a line, rest on a free square and move in a different path from that point to clear one or more opposing pieces from the board, and continue in that manner, all in one turn of play, until there is no path available to clear. In this regard, it is important that the presence of even one of a player's own checker pieces in a line of consecutive pieces pathway is a complete obstacle to path-clearing.

The game is won when the last opposing piece is captured, or is unable to move. The game ends in a draw if only two players (or two teams) are left and neither can defeat the other after ten moves.

DETAILED DESCRIPTION OF THE INVENTION

Figure 1:
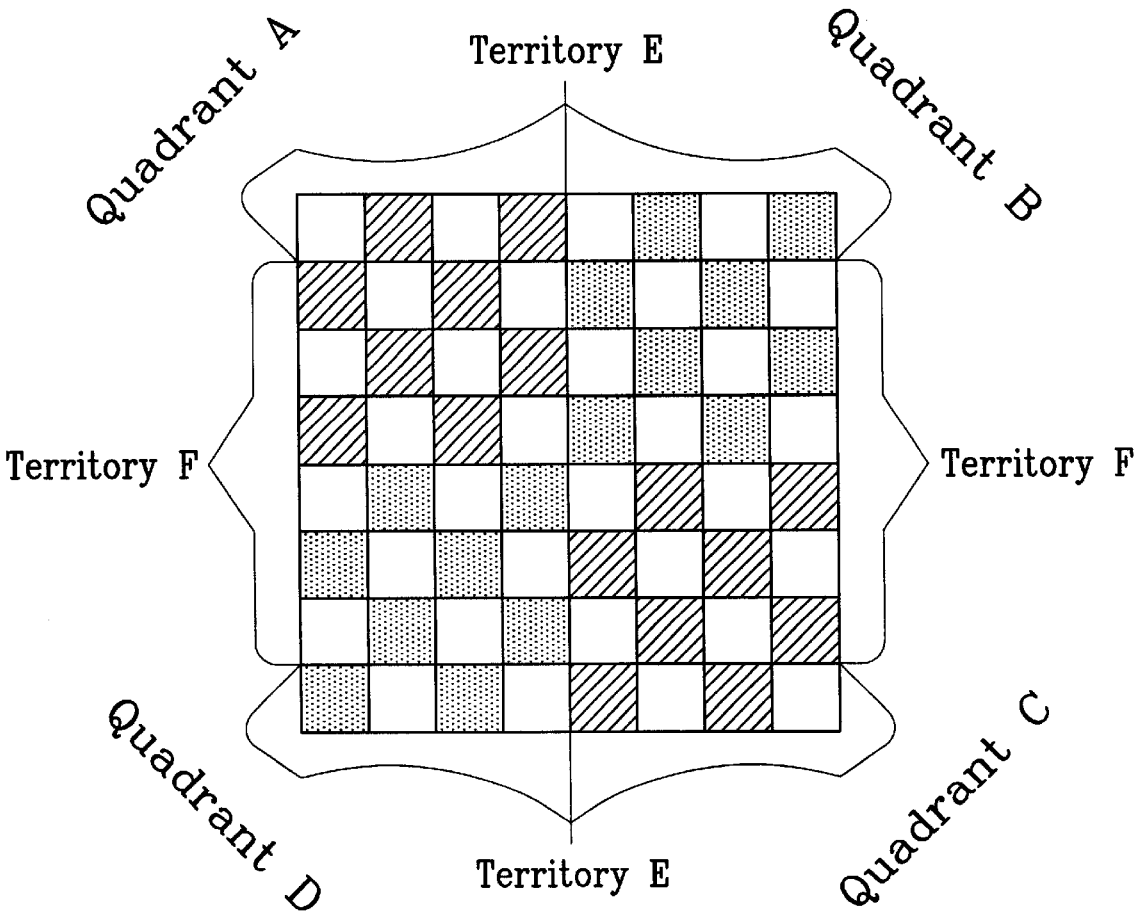
FIG. 1 is a topside view of a checkerboard with 4 quadrants A, B, C and D. on which the 8-square potential superking or superqueen rows, together containing all four corner squares of the board, are each marked E and the shorter 6-square containing perpendicular rows where an ordinary checker may become a king or queen are each marked F.

The present game is designed in a way that enables it to be customized relative to each of: (1) colors A, B, C and D, (2) the colors, form and shape of the "checker" pieces and (3) the materials used for making the board, the checker pieces, the risers and/or double risers and the way in which the risers and double risers are constructed. Alternatively, a standardized design can readily be evolved for bulk manufacture and mass marketing.

In some embodiments, especially in the "sports" area, the checkers may be figures of players of the sport wearing authentic uniforms in the colors of well-known professional (including semi-pro) or college teams. In such instances the figures are mounted on pieces of wood, heavy plastic or some other solid substance, which pieces are each adapted to be stably but detachably joined to a riser. The game, when played with figures as checkers can be designed in various ways. For example, children's checker games may employ as checkers cartoon character figures or fairy tale character figures, in each instance mounted on a base adapted to be stably but detachably joined to a riser. Animal figures, bird figures, fish figures, likewise mounted to a base may be used. So can flowers, trees, emblems of organizations, flags for different countries or any other type of figure that makes the game more enjoyable to the players or more attractive to particular groups of people. Sports checkers may also be played with balls symbolic of the sport—e.g., golf balls, baseballs, footballs, basketballs—or with helmets such as players of the sport may wear e.g. football helmets, or with baseball caps, or implements used in the sport, e.g. golf clubs, hockey sticks, etc. The bases on which the figures are mounted, when figures are used, may be of any shape desired. Usually the size and shape of each of a base piece and a coordinated riser piece are identical, while any coordinated double riser piece included in the game will be of the same shape and of the same size when viewed from a top view but will have twice the height of the base piece and the riser piece. The size of the base piece and the riser piece is necessarily selected to fit within the boundaries of a single square on the checkerboard and also to lend stability to any figure mounted on the base piece. The shape of these pieces can be square, rectangular, round, oval, triangular or any other shape desired. If the checker pieces are not figures but are simply geometric solids constructed from wood, plastic or the like, they can be of any shape and any height desired, and in such instances the coordinated riser must conform to the shape of the bottom of the figure but can be of a lesser, convenient height. The coordinated double riser in that case will be identical to the single riser in every dimension but its double height.

Most preferably, for the convenience of the players, each set of 6 checkers included in the game is color coordinated to the non-background color of one of the quadrants of the board so that the player playing in Quadrant A uses checkers at least in significant part of the same color as the Color A squares in that quadrant, etc. The game may also be played, however with an ordinary 2-color board and with four sets of six checkers wherein each set has a different main color. It is also consistent with the theme of the game that the 4 sets of checkers be of one color but be so different in shape from set to set that each set is readily distinguish able from all others.

The base of the checkers is so constructed that it can easily be stably, but detachably, mounted to a coordinated riser or double riser. This can be done in a variety of ways that will readily occur to those familiar with stable detachable mountings. For example, the bottom of the base and the top of a riser or double riser may each be equipped with a piece of velcro, the pieces being so selected that the velcro meshes when the pieces are joined but releases when they are detached. As another example, the checker base may contain one or more indentations that mate with one or more projections on the top surface of the riser when the pieces are joined and releases when they are pulled apart. If only single risers, and no double risers, are provided in the game, the bottom of each riser is formed in the same way as the bottom of the checker pieces, thereby enabling two risers to be joined to each other when it is necessary to convert a checker piece to a superking or superqueen. When double risers as such are provided in the game box, it is unnecessary for their bottoms or those of the single height risers, to be formed in the same way as checker bottoms.

The board itself may be of any desired material and may be foldable into a half-size like many checker boards are, but need not be. If foldable, it will generally be of heavy cardboard, with a laminated paper, cloth or plastic facing on which the colored checkerboard has been imprinted on one side and a protective heavy paper, plastic or cloth coating chosen to make the board durable, on its opposite side.

If desired the board may be more durably constructed of wood, heavy plastic or some other solid material, with the checkerboard squares painted or screen-printed thereon.

The terms "queen" and "superqueen" have been introduced with "sports" checkers particularly in mind, to accommodate the situation wherein each 6-member checker piece set represents a girl's or women's sports team. Queens and kings for purposes of the present game are equals and the attainment, or loss, of either is scored identically. The same principle is applied in the same way to superkings and superqueens. The use of "queen" and "superqueen" may be applied to any checker that embodies a clearly female figure, if desired; its usage is a matter of players' choices. For simplicity and ease of expression, kings and queens are collectively referred to as "monarchs" in the ensuing claims, while "superkings" and "superqueens" are collectively referred to as "super-monarchs".

The initiation of the play of the game may be orchestrated in any way the players agree upon. The players may simply agree that the one playing a particular quadrant moves first and that each player thereafter plays his or her turn in clockwise progression around the board. The players may also agree to a coin toss, a dice throw, the spin of a wheel or the draw of a straw to determine who moves first. They may agree to having the player whose first name (or last name) is first in alphabetical order begin the game, followed alphabetically by the next in such order, etc., or to proceed in date order of their birthdays. They may assign quadrants of the board to individual players on any of these premises or on any other that they select. They may agree to either clockwise or counterclockwise play around the board after the first player plays. None of these points is critical so long as some orderly way of selecting the first player to play is agreed upon and some orderly progression of the other players' plays in relation to the assigned quadrants of the board is established.

The players may also agree to play on either the 32 background squares or the other 32 squares of the board. In the ensuing claims, the term "playing square" refers to the 32 alternating squares chosen for purposes of play.

Figure 2:
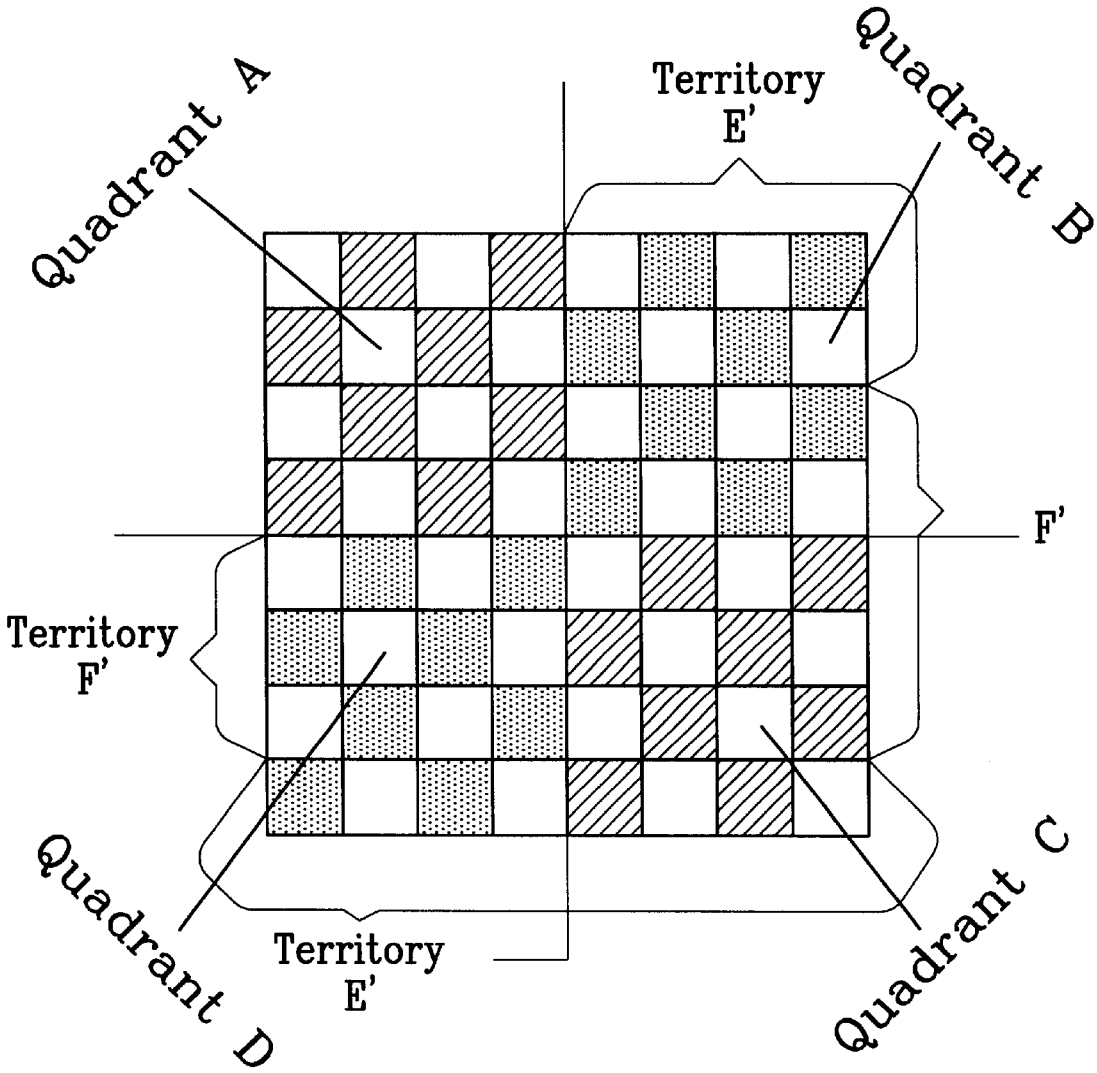
FIG. 2 is another topside view of a checkerboard wherein the quadrant A represents the territory of one player in a 4-player game and the rows and row-portions which any of the A player's checkers must enter in order to become a superking or superqueen are marked E', while the spaces any of the A player's checkers must reach to become a king or queen are marked F'.

The board, as depicted in FIGS. 1 and 2 has two outermost 8-square rows (designated as E) at the extreme opposite ends of the board which are the superking (or superqueen) rows. The player in Quadrant A may achieve superking (or superqueen) status for any checker successfully moved to the E section of any of Quadrants B, C, and D; the player in Quadrant B may accomplish that status for any checker successfully moved to the E section of any of Quadrants A, C or D; the player in Quadrant C must move a checker to E section of one of Quadrants A, B or D in order to convert it to a superking (or superqueen) and the player in Quadrant D must move a checker to the E section of Quadrant A, B, or C to convert it to the superking (or superqueen) status.

In this game, it is not necessary for a superking to first become a king, nor is it necessary for a superqueen to first become a queen.

From looking at FIGS. 1 and 2, it will be readily perceived that there are a limited number of squares to which players can move their checkers in order to convert them to king (or queen). More particularly, the F region of FIG. 1 and the F' region of FIG. 2 illustrate, when compared to the E and E' regions that there are six squares available to each player to move one of his checkers into, in which the checker so moved becomes a superking or superqueen, but a lesser number of squares are available for conversion of ordinary checkers to king or queen status.

It should be recognized that the superking/superqueen row runs across a full eight squares at each end of the board, and these comprise four background color squares and four colored squares from Quadrants A, B, C or D. The game, as already noted, can be played on the background squares or on the alternate squares, however marked or colored; in either instance only four playing squares are available at each end of the board for conversion of checkers into superkings or superqueens. Of these eight squares, two squares are individually unavailable to each of the four players because they are in his or her own quadrant of the board. Because superkings/superqueens have power to capture a large number of checkers at once, players of the game may endeavor to protect the superking/superqueen spaces in their respective territories by retaining their own checkers in those spots for as long as possible. The challenge of attaining the superking/superqueen status for a given checker is accordingly a substantial one, which adds to the excitement and interest of the game.

The challenge of how to convert a checker to a king or queen is also enhanced over the classical two-person checkers game. Because the game board is a perfect square, the king/queen regions shown as F on FIG. 1 each consist of only 6 squares on each side of the board, consisting of three background squares and 3 colored squares, with the practical result that there are only playing squares that are 3 king/queen—making squares on each side of the board. Of these, a given player will not have access for king or queen-making purposes to those falling within his or her own quadrant. The net result is that in any given game, there will be 5 squares into which two of the players can move checkers to convert them into kings or queens and only 4 squares into which the other two players can move to achieve that result. For example, the player in Quadrant A can move into any of the one territory F square of Quadrant B or the two territory F squares of quadrant C or the one territory F square of quadrant D to create a king or queen while the player of Quadrant B can move into either of the two territory F squares of Quadrant A, the one territory F, square of Quadrant D or the two territory F squares of quadrant C to achieve that result. The quadrant C player, like the Quadrant A player can move into any of four squares (two in quadrant A, and one in each of Quadrants B and D) while the Quadrant D player, like the Quadrant B player, can move into any of five squares (two in each of quadrants A and C and one in quadrant B) to achieve king or queen status. It is recommended that players playing two or more games in succession work out a system of changing seats or rotating the board at the end of each game, or playing on alternate squares of the board from those utilized in the first game, so that those players with access to only 4 king/queen spots in the first game have access to 5 such spots in the succeeding game, while those players having 5 king/queen sites available in the first game have 4 in the second game, thereby equalizing the players' access to king/queen-making slots over the span of any 2-game session.

Figure 3:
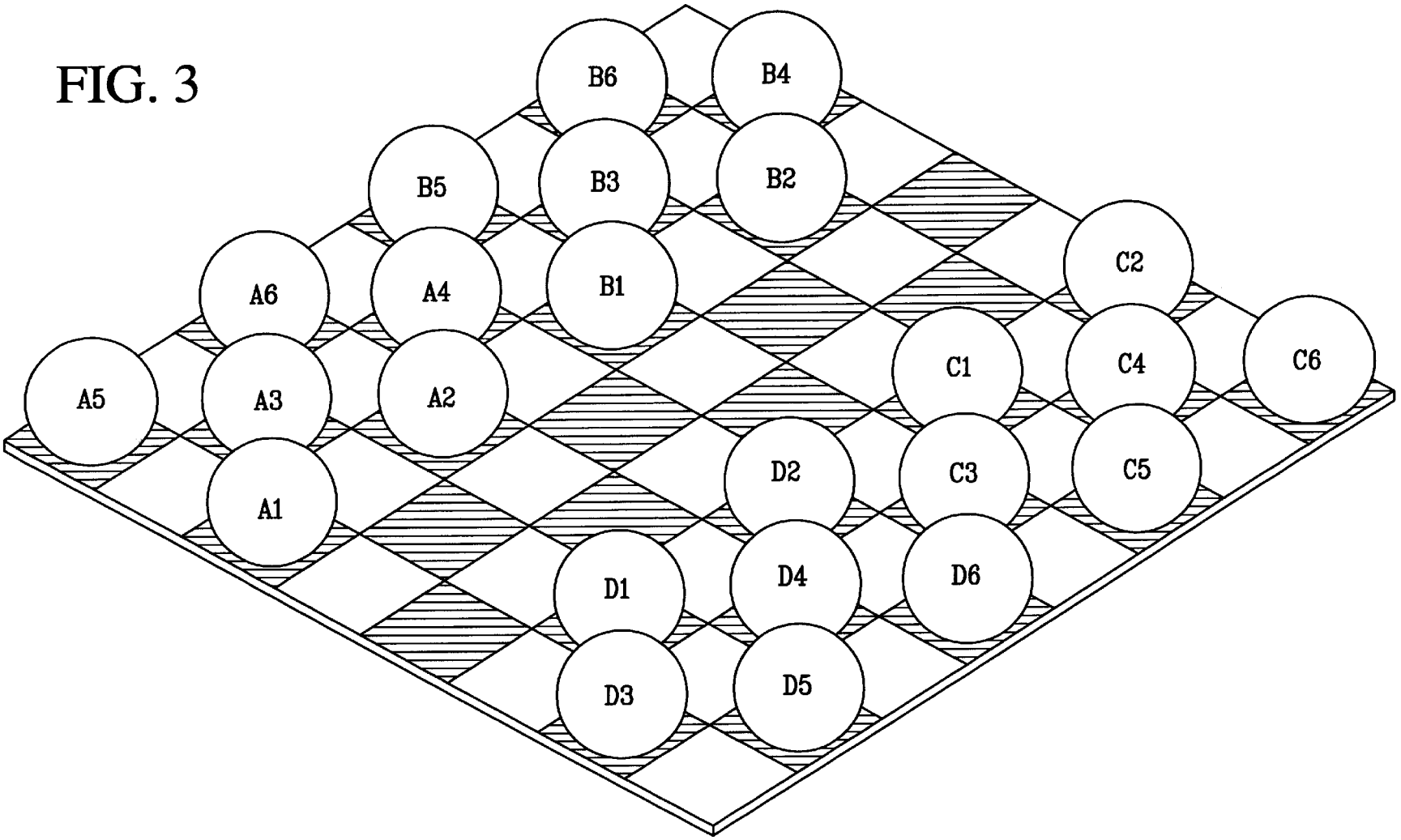
FIG. 3 is a topside view of the board showing it set up with full sets of A-, B-, C- and D-labelled checkers.
Figure 4:
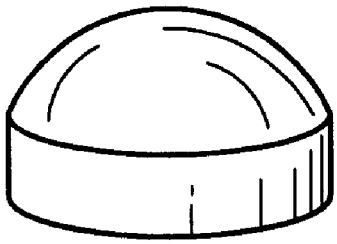
FIGS. 4 and 5 depict, respectively, examples of a riser and a double riser.
Figure 5:
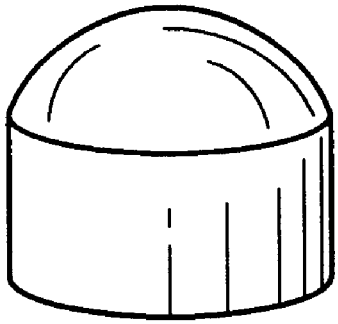
Figure 6:
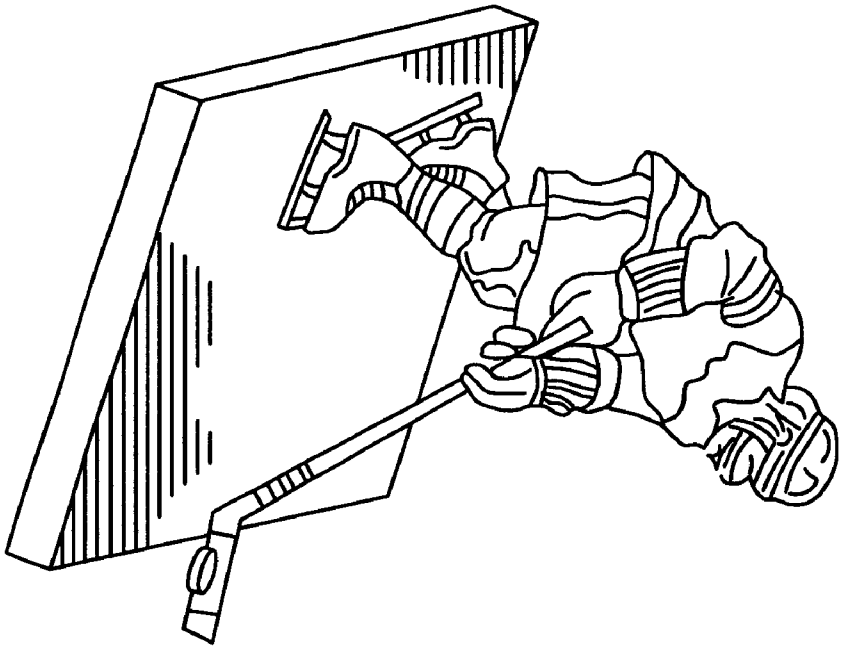
FIG. 6 depicts the figure of a hockey player on a base and thus illustrates a form of "checker" piece contemplated herein.

A better idea of the complications introduced into the game as herein described can be attained from looking at FIG. 3 in which ball-shaped figures are checkers. These checkers have all been labelled as "A", "B", "C", or "D" checkers according to the quadrant in which each is located as play begins. Each of the A, B, C and D checkers has been numbered with a number from 1 to 6. As is evident, checkers A2 and C1, e.g. can each readily be converted to a king or queen in two moves, A2 by moving toward the open king/queen square of the D territory and C1 by moving to the open king/queen square of the B territory. Assuming A2 makes a move toward the D square, and player B moves next to block the open king/queen square of his territory by placing B2 in it, player C may then elect to move C2 between the new B2 (edge) position and C1, while player D, moving next, can readily block the open king/queen position of his territory and thwart A's initial plan by simply placing D1, in one move, in the D territory open king/queen position. Thus, while B2 and D1 have foiled the A2 and C1 aspirations of early king/queen attainment, each now needs to plan how best to advance next. Player A's next move is most likely to position A3 or A4 behind A2, but it could also be to move A2 back to its original position while watching all the rest of the players make one more move.

As can be seen the game as so played is complex, as well as highly competitive, and it readily engages attention of all players in trying to evolve the best tactical moves.

The board game as described in detail above can readily be converted, using techniques well known in the art to a hand-held novelty game implemented by built-in software or a suitable microchip. Using such a device, a single player may play against the device's play of 3 quadrants of the board or alternatively, the device may be implemented to allow the player to play two quadrants or three quadrants against, respectively, two quadrants or one quadrant by the board. In all cases, the built-in software or the microchip will be designed to implement the rules of the game and regulate play according to them.

U.S. Pat. No. 6,182,967 issued Feb. 6, 2001 describes a board game optimally for 2 players which combines features which the patent suggests may be implemented on a personal computer or on a host server for a network and may, in either case, be set up to allow the play to be executed as player against player or player against computer. The present board game can likewise readily be implemented and set up for play similarly, as will be readily apparent to persons of skill in converting various manual procedures to computerized formats.

Variations beyond those specifically mentioned herein especially in regard to the selection of game pieces, the appearance of the board, the mode of identifying the quadrants A, B, C and D, and other details that in no way change the spirit of the game as described or the way in which it is basically played, will readily occur to those of ordinary skill in the art of games and game-playing. It is accordingly intended that the present invention be limited only by the appended claims.

I claim:

1. A checker-type game for up to four players which comprises (a) a square checker board having a total of 64 squares, with not more than 32 squares in one color and not more than 32 squares in another contrasting color with the squares arranged so that the colors alternate, (b) four sets of 6 checker pieces, wherein the pieces of each set are distinguished visually from the pieces of any other set by color, shape, markings, height or any combination of two or more thereof and the bottom surface of each checkerpiece is adapted to mate mechanically with and adhere removably to the top surface of a riser or double riser piece; and (c) four sets each comprised of 6 riser pieces wherein each the pieces of each set are coordinated in at least color, dimensions and shape to the bottoms of the checker pieces of one of the four sets of 6 checker pieces, wherein each riser piece has a smooth bottom surface and the top surface of each riser piece is adapted to mate mechanically with and adhere removably to the bottom surfaces of the checker pieces of the coordinated set of checker pieces and (d) 4 sets each of either (A) 6 riser pieces which are as described in subparagraph (c) hereof with the additional requirement that the bottom surface of each of these riser pieces is not smooth but is fashioned and adapted to mate mechanically with and adhere removably to the top surface of a riser piece as described in subparagraph (c) hereof or (B) 4 sets each of double riser pieces which differ from the riser pieces of subparagraph (c) hereof only in that each piece is double the height of such a riser piece height of said riser pieces, and (e) a set of rules for playing a modified game of conventional checkers wherein:

(i) the checkerboard is divided into four 16 square quadrants and each of four players adopts one of the quadrants as that player's own territory, (ii) each player is provided with one six-piece set of checker pieces, one set of six riser pieces as described in subparagraph (c) hereof and either one set of 6 riser pieces or one set of six double riser pieces as described in subparagraph (d) hereof, (iii) each player competes with all three of the other players to remove all checker pieces other than that player's own checker pieces from the checkerboard, (iv) all checker pieces may be moved in any direction, (v) each player endeavors to improve the rank of each of that player's own checker pieces to monarch or supermonarch by moving those checker pieces into an edge-abutting playing square of the checkerboard that is outside that player's quadrant, (vi) the checkerboard's fourteen edge-abutting playing squares are so allocated that: (A) when a player moves one of his checker pieces into any of eight edge-abutting playing squares, four of which are located along each of two opposite sides of the checkerboard, and that playing square is located outside his own quadrant, that checker piece becomes a supermonarch and the player may either mechanically mate that checker piece to a double riser piece or mechanically mate it to a riser piece as described in subparagraph (d) hereof, which riser piece has already been or is immediately thereafter mated to a riser piece as described in subparagraph (c) hereof to signify elevation of the checkerpiece to supermonarch, and (B) when a player moves one of his checker pieces into any of the six edge abutting playing squares, three of which are located on each of the remaining two opposite sides of the checkerboard, which edge-abutting playing square is not in the player's own quadrant, that checkerpiece becomes a monarch and the player may mechanically mate it to a riser piece as described in subparagraph (c) to signify the elevation of that checkerpiece to monarch, (vii) a player may jump move a supermonarch over two or more of any of the opponents' checkerpieces, monarchs and supermonarchs that are located in successive playing squares with a vacant square at the end and may also make successive jump moves in any direction by a supermonarch in a single turn and may clear the checkerboard of all jumped items, and (viii) a player may jump move a monarch over and then remove from the checkerboard an opposing player's supermonarch but may not jump over a series of opposing players' checkerpieces, monarchs or supermonarchs and may not make multiple jumps in a single turn.

2. A game according to claim 1 wherein the four sets of checker pieces are each of a different color and each 16-square quadrant of the checkerboard contains eight alternating squares of a color that matches the color of one of the four sets of checkerpieces.

3. A game according to claim 2 wherein the four sets of checker pieces are identical except for color.

* * * * *